US009057380B2

(12) United States Patent
Lin

(10) Patent No.: US 9,057,380 B2
(45) Date of Patent: Jun. 16, 2015

(54) FAN HAVING DEBRIS ENTRY PREVENTION GAP

(75) Inventor: Shih-Chieh Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 338 days.

(21) Appl. No.: 13/538,539

(22) Filed: Jun. 29, 2012

(65) Prior Publication Data

US 2014/0003935 A1 Jan. 2, 2014

(51) Int. Cl.

| | |
|---|---|
| ***F04B 35/04*** | (2006.01) |
| ***F04D 25/06*** | (2006.01) |
| ***F04D 29/52*** | (2006.01) |
| ***F04D 29/40*** | (2006.01) |
| ***F04D 29/08*** | (2006.01) |
| ***F04D 29/32*** | (2006.01) |
| ***F04D 25/08*** | (2006.01) |

(52) U.S. Cl.

CPC ..... *F04D 25/062* (2013.01); *F04D 29/522* (2013.01); *F04D 29/403* (2013.01); *F04D 29/083* (2013.01); *F04D 25/0613* (2013.01); *F04D 29/325* (2013.01); *F04D 25/082* (2013.01); *F04D 29/329* (2013.01)

(58) Field of Classification Search

CPC ... F04D 29/329; F04D 29/083; F04D 29/263; F04D 29/403; F04D 29/642; F04D 29/325; F04D 29/522

USPC ..... 417/354, 352

See application file for complete search history.

(56) References Cited

U.S. PATENT DOCUMENTS

| | | | | |
|---|---|---|---|---|
| 6,158,985 | A * | 12/2000 | Watanabe et al. | 417/423.14 |
| 2002/0025261 | A1* | 2/2002 | Kudo et al. | 417/354 |
| 2006/0147322 | A1* | 7/2006 | Lee | 417/366 |
| 2006/0280625 | A1* | 12/2006 | Moreau | 417/366 |
| 2009/0066178 | A1* | 3/2009 | Lin | 310/90 |
| 2009/0185919 | A1* | 7/2009 | Yoo et al. | 417/354 |
| 2009/0285699 | A1* | 11/2009 | Muraoka et al. | 417/354 |
| 2011/0027075 | A1* | 2/2011 | Nogami et al. | 415/182.1 |

* cited by examiner

*Primary Examiner* — Bryan Lettman
*Assistant Examiner* — Timothy P Solak
(74) *Attorney, Agent, or Firm* — C. G. Mersereau; Nikolai & Mersereau, P.A.

(57) ABSTRACT

A cooling fan structure includes a hub, a rotary shaft, a fan seat, and a stator assembly. The fan seat is provided on around a front end corresponding to a rear end of the hub with a forward protruded annular rim portion and a sunken annular groove portion adjoining an inner lower side of the rim portion. The protruded annular rim portion reduces a gap between the hub and the fan seat to reduce the amount of air flowing into the hub via the gap and accordingly prevents external foreign matters from invading the hub via the same gap to adversely damage components inside the hub or cause a stuck hub; and the groove portion provides an additional space for receiving invaded and accumulated foreign matters to thereby reduce the possibility of a stuck hub. With these arrangements, the cooling fan can have prolonged service life.

4 Claims, 8 Drawing Sheets

FAN HAVING DEBRIS ENTRY PREVENTION GAP

FIELD OF THE INVENTION

The present invention relates to a cooling fan structure, and more particularly to a cooling fan structure that effectively prevents foreign matters from invading and accumulating in an interior of the fan to adversely cause a stuck hub.

BACKGROUND OF THE INVENTION

A conventional cooling fan usually includes a stator, a rotor, a circuit board, a plurality of fan blades, and a fan frame.

With the constantly widened applications in different fields thereof, the cooling fan has been used with many electronic devices for special purposes, such as central processing units (CPU), servers, power supplies, communication chassis, and base stations for telecommunication. These electronic devices using cooling fans are also often used in very severe environments, such as humid, wet, dust-containing, and salt spray environments. Since general cooling fans are not provided with any protective structure against water, moisture, salt spray and other foreign matters, the stator and bearing, or even the circuit board, inside the fan are subjected to invasion by water, salt spray and foreign matters and become corroded or stuck or damaged, which largely shortens the service life of the fan.

To solve the above problem, a solution involving injection molding has been proposed. According to the injection molding solution, the stator and the circuit board are first assembled to the fan frame to form a subassembly, and then, the subassembly is put in a mold and a molding material is injected into the mold. After the molding material is hardened, the subassembly is enclosed in the molding material and then removed from the mold. The molding material not only encloses the subassembly, but also fills up all internal spaces in between and around the stator and the circuit board, so as to provide a watertight effect. However, since the molded injection material is thick, it would have adverse influence on the heat dissipation of the electronic components enclosed in the molding material to result in burned-out electronic components and failed fan.

The above-described injection molding solution is mainly used to protect the electronic components against short circuit and burnout due to corrosion caused by invaded water and salt spray, and is only effective for protecting the circuit board against moisture and water. Further, the fan motor being enclosed in the injected molding material to protect the circuit board against water and salt spray has obviously reduced heat dissipation performance and tends to have an elevated temperature. Moreover, the injection molding solution could not prevent or solve the problem of accumulation of foreign matters in the fan to cause a stuck hub. Therefore, the conventional cooling fan has the following disadvantages: (1) having shortened service life; (2) causing accumulation of heat in the fan; (3) having poor heat dissipation efficiency; and (4) easily becoming stuck due to foreign matters accumulated therein.

SUMMARY OF THE INVENTION

A primary object of the present invention is to provide a cooling fan structure that effectively reduces the amount of foreign matters that invade an interior of the fan.

Another object of the present invention is to provide a cooling fan structure that effectively prevents external foreign matters from excessively accumulating in a fan to cause a stuck hub.

To achieve the above and other objects, the cooling fan structure according to the present invention includes a hub, a rotary shaft, a fan seat, and a stator assembly.

The hub has a first wall portion and a second wall portion connected to each other, a plurality of blades outward extended from an outer circumferential surface of the second wall portion, and a magnetic body provided on an inner circumferential surface of the second wall portion. The rotary shaft has a first end and an opposite second end, and the first end of the rotary shaft is connected to the first wall portion of the hub. The fan seat has a hollow bearing cup forward extended from a central portion thereof for receiving at least one bearing therein, and the rotary shaft is rotatably connected at the second end to the bearing. The fan seat is provided at a position corresponding to and facing toward a rear end of the second wall portion of the hub with a forward protruded annular rim portion and a sunken annular groove portion adjoining a lower inner side of the annular rim portion. The stator assembly is fitted on around an outer side of the hollow bearing cup.

With the above arrangements, the cooling fan structure of the present invention is able to prevent external foreign matters from invading an interior of the fan, and can also avoid the risk of stuck hub and fan seat due to foreign matters accumulated therein. Thus, the cooling fan can have prolonged service life.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
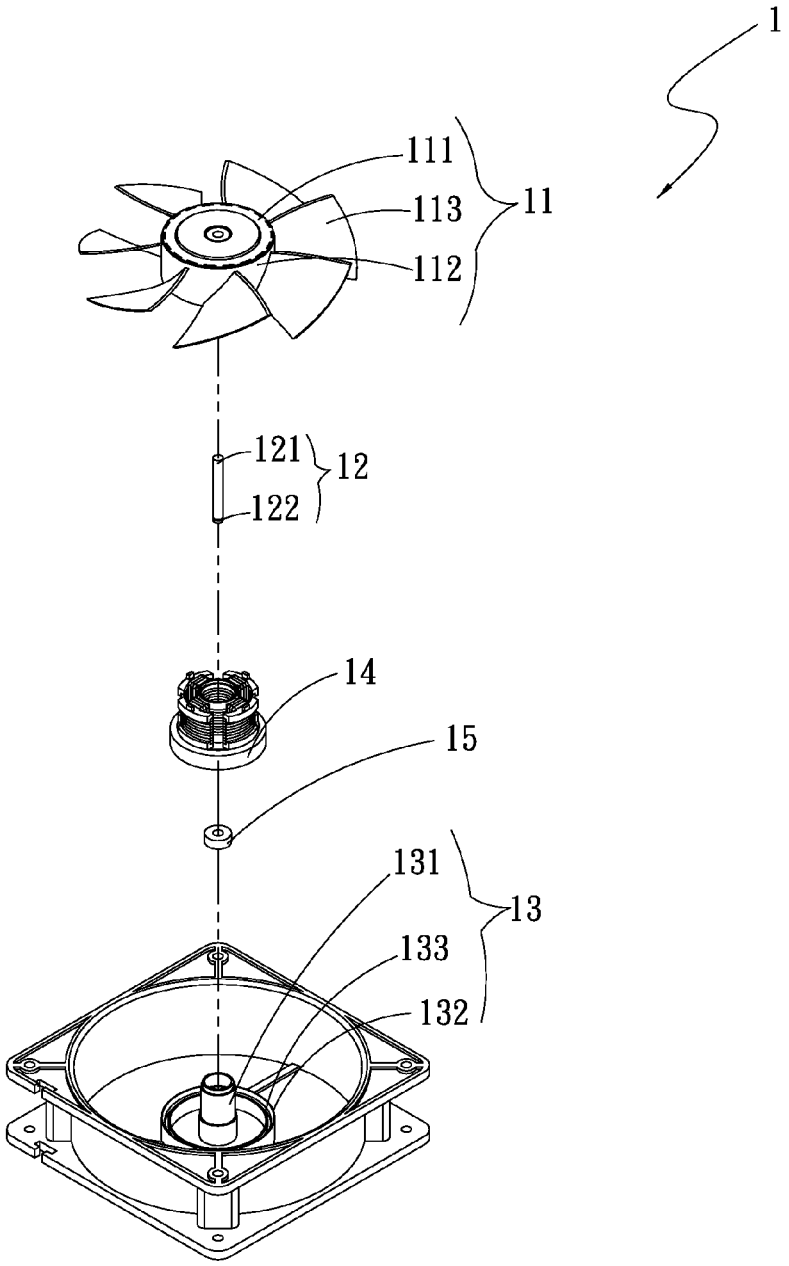
FIG. 1 is an exploded perspective view of a cooling fan structure according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 2:
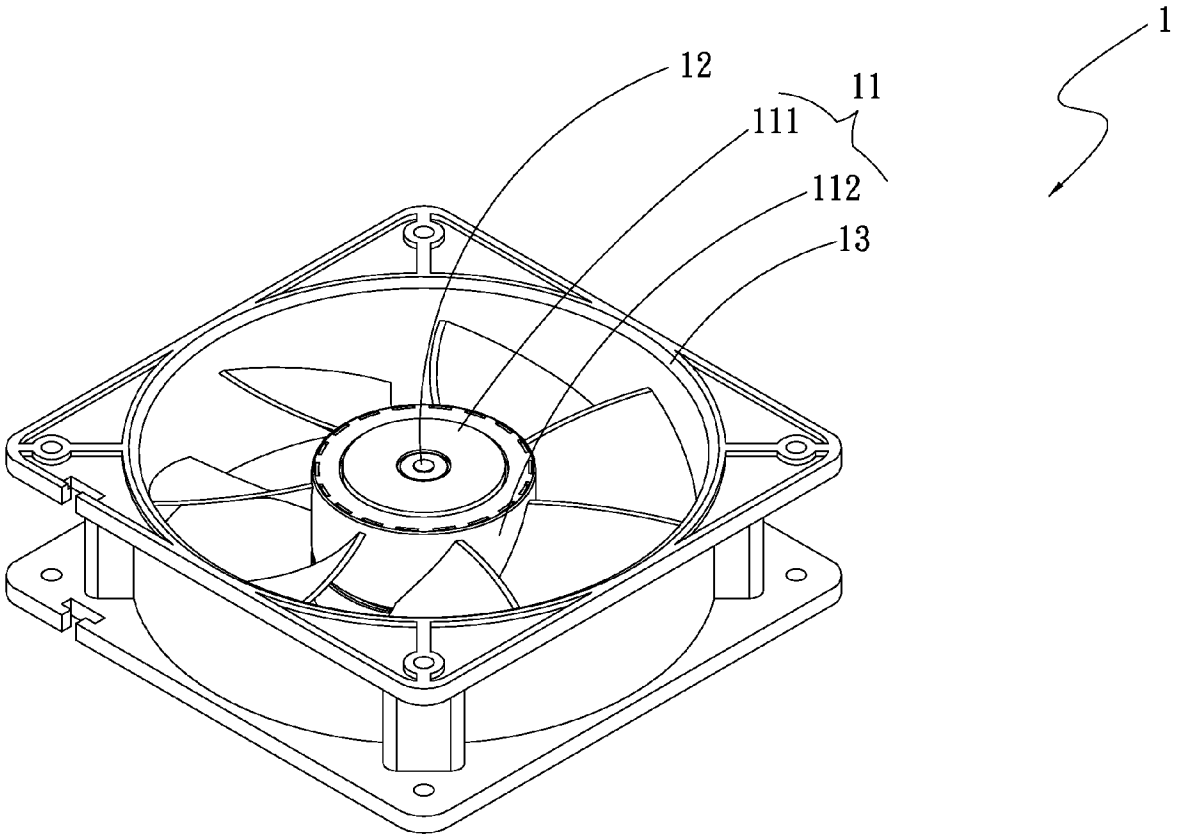
FIG. 2 is an assembled view of FIG. 1.
Figure 3:
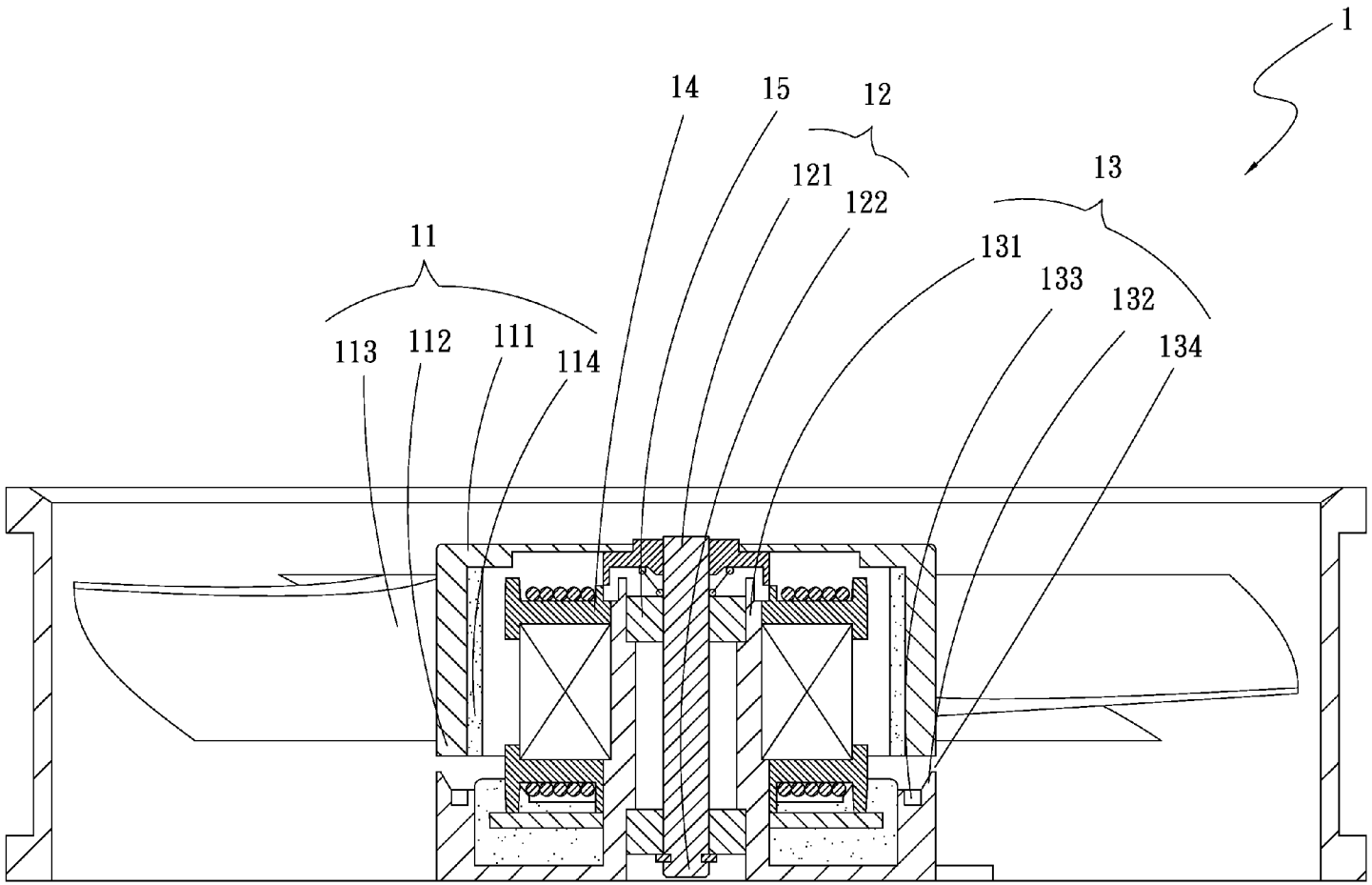
FIG. 3 is a centered sectional view of FIG. 2.

Please refer to FIGS. 1 and 2 that are exploded and assembled perspective views, respectively, of a cooling fan structure 1 according to a first embodiment of the present invention, and to FIG. 3 that is a centered sectional view of FIG. 2. As shown, the cooling fan structure 1 in the first embodiment includes a hub 11, a rotary shaft 12, a fan seat 13, and a stator assembly 14.

The hub 11 includes a first wall portion 111 and a second wall portion 112 connected to each other, a plurality of blades 113 outward extended from an outer circumferential surface of the second wall portion 112, and a magnetic body 114 provided on an inner circumferential surface of the second wall portion 112.

The first wall portion 111 is located at a top of the hub 11, and the second wall portion 112 has a front end perpendicularly connected to a circumferential edge of the first wall portion 111.

The rotary shaft 12 has a first end 121 and an opposite second end 122, and the first end 121 of the rotary shaft 12 is connected to the first wall portion 111 of the hub 11.

The fan seat 13 includes a hollow bearing cup 131 forward extended from a central portion thereof for receiving at least one bearing 15 therein. The rotary shaft 12 is rotatably connected at the second end 122 to the bearing 15. The fan seat 13 is provided at a position corresponding to and facing toward a rear end of the second wall portion 112 with a forward protruded annular rim portion 132 and a sunken annular groove portion 133 adjoining a lower inner side of the annular rim portion 132. The rim portion 132 may be triangular, upward tapered, or upward pointed in its cross-sectional shape; and the groove portion 133 may be rectangular or concave in its cross-sectional shape.

The stator assembly 14 is fitted on around an outer side of the hollow bearing cup 131.

In the illustrated first embodiment, the annular groove portion 133 is continuously extended on around the fan seat 13 at a position corresponding to and facing toward the rear end of the second wall portion 112 of the hub 11.

Figure 4:
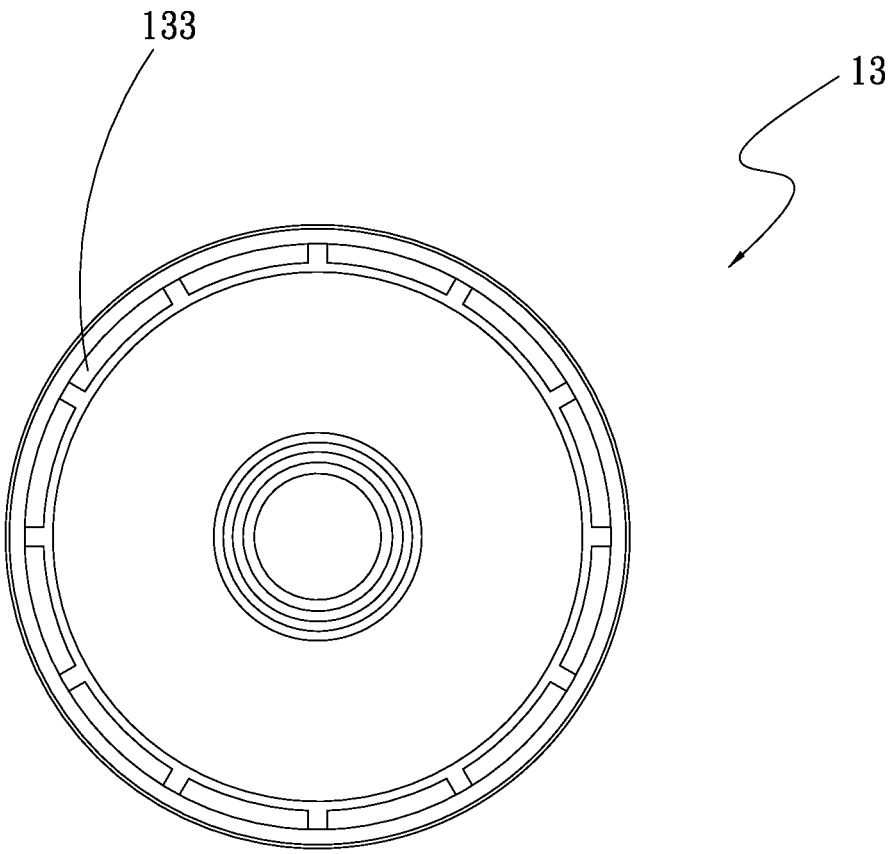
FIG. 4 is a top view of fan seat for a cooling fan structure according to a second embodiment of the present invention.

Please refer to FIG. 4 that is a top view of a fan seat 13 for a cooling fan structure according to a second embodiment of the present invention. Since the cooling fan structure in the second embodiment is generally structurally similar to the first embodiment, it is not repeated described in details herein. The second embodiment is different from the first embodiment in that it has a groove portion 133 includes a plurality of segments spaced on around the fan seat 13 at a position corresponding to and facing toward the rear end of the second wall portion 112 of the hub 11, similar to the position as can be seen in FIG. 3.

Figure 5:
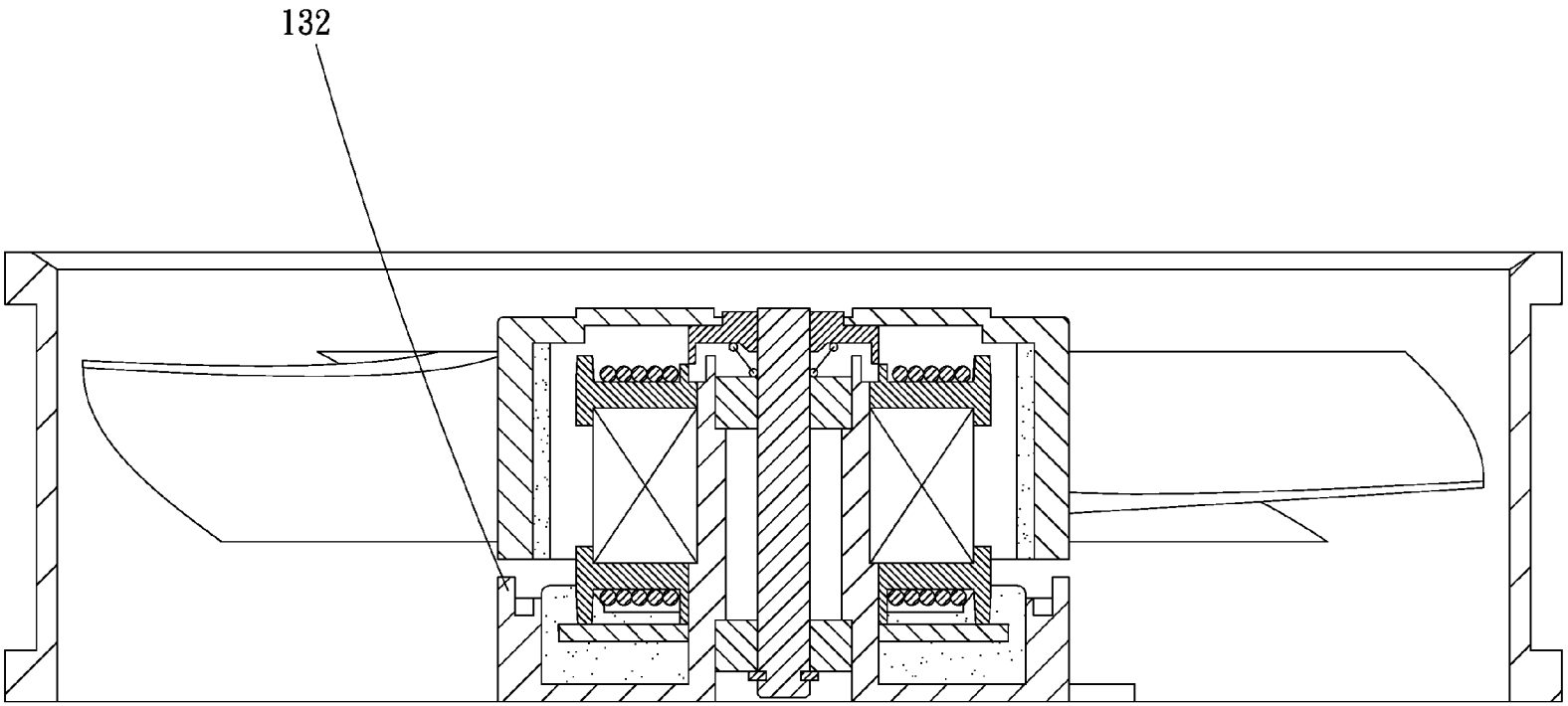
FIG. 5 is an assembled centered sectional view of a cooling fan structure according to a third embodiment of the present invention.

FIG. 5 is a centered sectional view of a cooling fan structure according to a third embodiment of the present invention. As shown, the third embodiment is generally structurally similar to the first embodiment, except that, in the third embodiment, the forward protruded annular rim portion 132 has a rectangular cross section.

Figure 6:
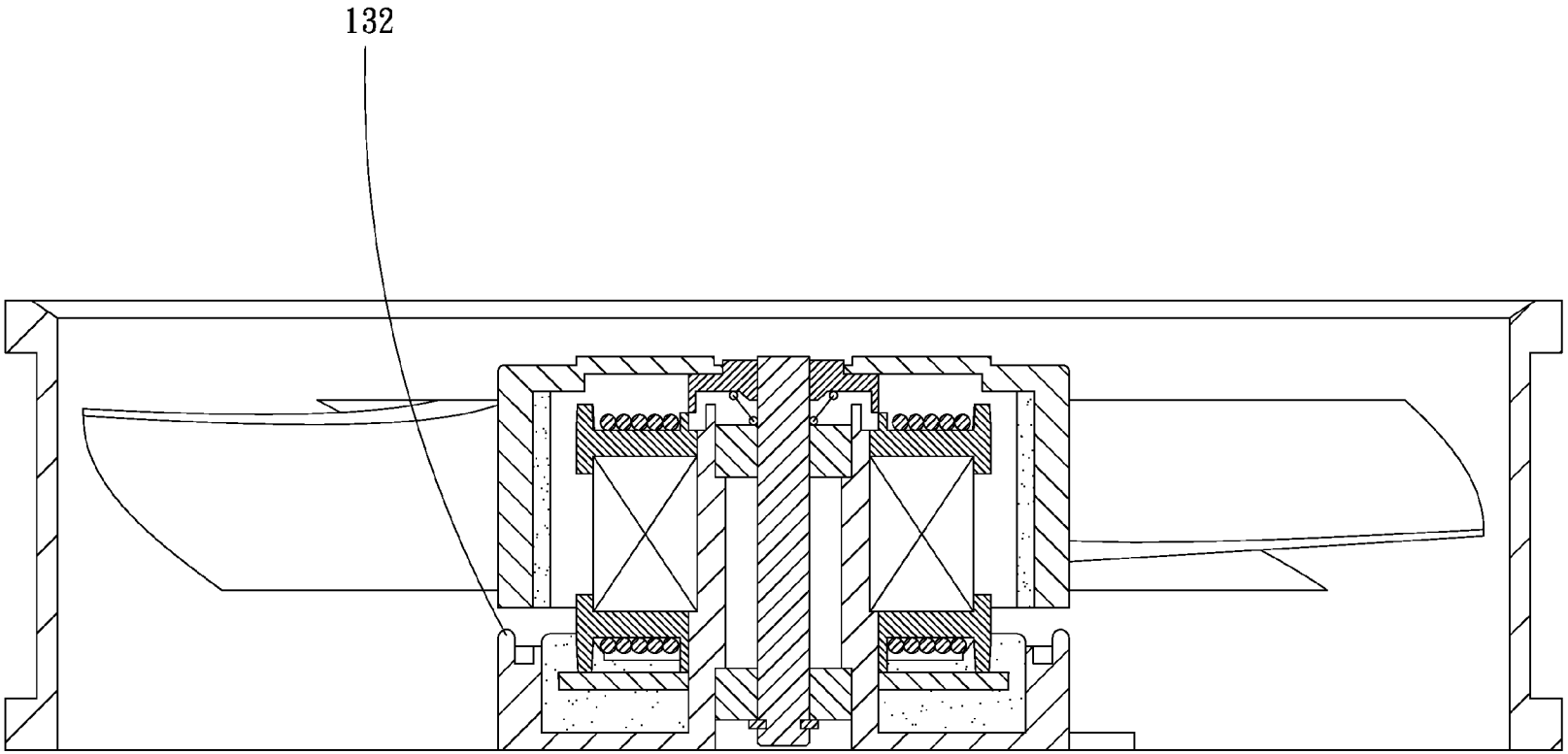
FIG. 6 is an assembled centered sectional view of a cooling fan structure according to a fourth embodiment of the present invention.

FIG. 6 is a centered sectional view of a cooling fan structure according to a fourth embodiment of the present invention. As shown, the fourth embodiment is generally structurally similar to the first embodiment, except that, in the fourth embodiment, the forward protruded annular rim portion 132 has a semicircular cross section.

Figure 7:
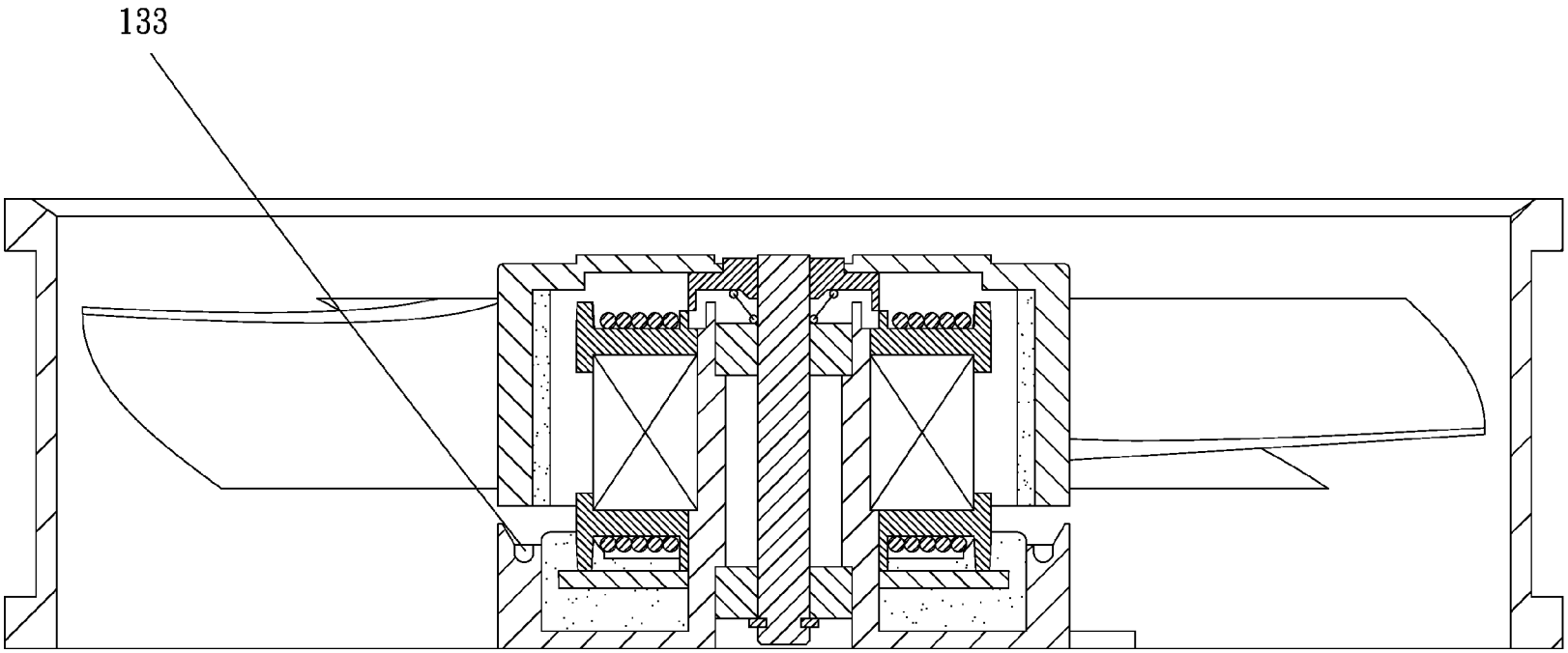
FIG. 7 is an assembled centered sectional view of a cooling fan structure according to a fifth embodiment of the present invention.

FIG. 7 is a centered sectional view of a cooling fan structure according to a fifth embodiment of the present invention. As shown, the fifth embodiment is generally structurally similar to the first embodiment, except that, in the fifth embodiment, the groove portion 133 has a semicircular concave cross section.

Figure 8:
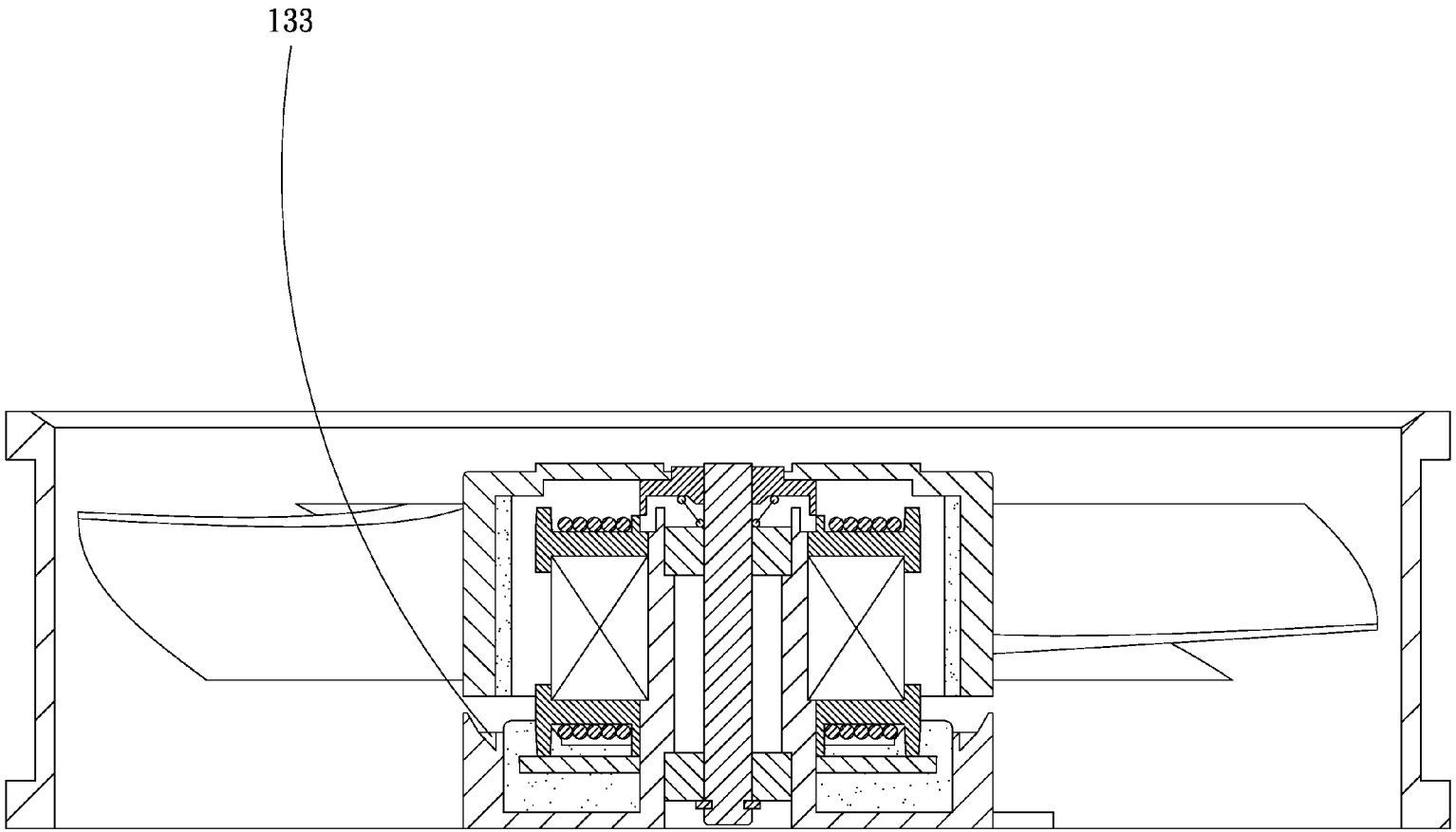
FIG. 8 is an assembled centered sectional view of a cooling fan structure according to a sixth embodiment of the present invention.

FIG. 8 is a centered sectional view of a cooling fan structure according to a sixth embodiment of the present invention. As shown, the sixth embodiment is generally structurally similar to the first embodiment, except that, in the sixth embodiment, the groove portion 133 has a downward pointed triangular cross section.

Please refer to FIGS. 1 to 8 at the same time. By providing the forward protruded annular rim portion 132 and the sunken groove portion 133 at the same time, as illustrated in the first to the sixth embodiments, the rim portion 132 not only reduces a gap 134 between the fan seat 13 and the hub 11 to thereby reduce the amount of external airflow flowing into an interior of the cooling fan via the gap 134, but also prevents external foreign matters from invading the hub 11 via the gap 134 to adversely damage components inside the hub 11 or cause a stuck hub 11; meanwhile, the groove portion 133 adjoining the inner lower side of the rim portion 132 provides an additional space for receiving invaded and accumulated foreign matters and thereby reduces the possibility of a stuck hub 11.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A cooling fan structure, comprising:

a hub having a first wall portion and a second wall portion connected to each other, a plurality of blades outward extended from an outer circumferential surface of the second wall portion, and a magnetic body provided on an inner circumferential surface of the second wall portion;

a rotary shaft having a first end and an opposite second end, and the first end of the rotary shaft being connected to the first wall portion of the hub;

a fan seat having a hollow bearing cup forward extended from a central portion thereof for receiving at least one bearing therein, and the rotary shaft being rotatably connected at the second end to the bearing; and the fan seat being provided at a position corresponding to and vertically facing toward a rear end of the second wall portion of the hub with a forward protruded annular rim portion, the annular rim having an outer side that is higher than a lower inner side, a sunken annular groove portion adjoining the lower inner side of the annular rim portion, and a gap being formed between the forward protruded annular rim portion and the second wall portion, wherein the outer side of the annular rim portion is aligned with the outer circumference of the second wall portion; and a stator assembly being fitted on around an outer side of the hollow bearing cup; wherein the annular groove portion is continuously extended on around the fan seat at a position corresponding to and facing toward the rear end of the second wall portion of the hub.

2. The cooling fan structure as claimed in claim 1, wherein the first wall portion is located at a top of the hub, and the second wall portion has a front end perpendicularly connected to a circumferential edge of the first wall portion.

3. The cooling fan structure as claimed in claim 1, wherein the rim portion has a cross-sectional shape selected from the group consisting of a triangular, a rectangular, a semicircular, an upward tapered, and an upward pointed shape.

4. The cooling fan structure as claimed in claim 1, wherein the groove portion has a cross-sectional shape selected from the group consisting of a triangular, a rectangular, a semicircular concave, and any other concave shape.

* * * * *